US006175974B1

(12) United States Patent
Draheim

(10) Patent No.: US 6,175,974 B1
(45) Date of Patent: Jan. 23, 2001

(54) CRIB DROPSIDE ASSEMBLY

(75) Inventor: Harvey J. Draheim, Weyauwega, WI (US)

(73) Assignee: Simmons Juvenile Products Company, Inc., New London, WI (US)

( * ) Notice: Under 35 U.S.C. 154(b), the term of this patent shall be extended for 0 days.

(21) Appl. No.: 09/363,211

(22) Filed: Jul. 29, 1999

Related U.S. Application Data

(60) Provisional application No. 60/094,797, filed on Jul. 31, 1998.

(51) Int. Cl.[7] ..... A47D 7/02
(52) U.S. Cl. ..... 5/100; 5/428
(58) Field of Search ..... 5/100, 93.1, 428, 5/429

(56) References Cited

U.S. PATENT DOCUMENTS 1,695,571 * 12/1928 Baxter ..... 5/100
5,072,464 12/1991 Draheim et al. ..... 5/93.1
5,617,593 * 4/1997 Pham ..... 5/100

FOREIGN PATENT DOCUMENTS

872296 * 7/1961 (GB) ..... 5/100

* cited by examiner

*Primary Examiner*—Alexander Grosz
(74) *Attorney, Agent, or Firm*—Hoffmann & Baron, LLP

(57) ABSTRACT

A crib dropside assembly is provided by the invention, including hardware for permitting the dropside to be raised or lowered with respect to a crib. The dropside includes a pin track including relatively long and relatively short, generally vertical segments, and a connecting segment connecting the relatively long and short segments. A pin access slot extends into one of the segments, and has an open end for permitting the entrance of a pin. The pin is preferably coupled to one of the crib endboards. A movable gate is provided for blocking the pin access slot when in a first position and opening the pin access slot when in a second position. An end cap may further be provided for providing access to a second slot formed in the dropside. The end cap may include a glide surface which bears against a crib corner post, thereby allowing the dropside to operate smoothly.

21 Claims, 23 Drawing Sheets

CRIB DROPSIDE ASSEMBLY

This application claims the benefit of U.S. Provisional Application Ser. No. 60/094,797, filed on Jul. 31, 1998.

BACKGROUND OF THE INVENTION

1. Field of the Invention

The field of the invention relates to crib dropside assemblies and the hardware used in connection with such assemblies.

2. Brief Description of the Related Art

Cribs are generally provided with dropsides which can be maintained either in raised or lowered positions. The dropside is raised to prevent an infant from climbing out of the crib. It is moved to the lowered position to facilitate access to the infant. A number of dropside assemblies have been developed for positioning the dropside in selected positions. U.S. Pat. No. 5,072,464 discloses one such assembly including a cable and spring-loaded locking pins. Another type of dropside assembly, which is presently in commercial use, includes a generally J-shaped pin track and a pin which is positioned in the pin track. The positioning of the pin in the track determines whether the dropside is in the raised or lowered positions.

Cribs are often provided to consumers in unassembled form. Ease of assembly is accordingly desirable. Some cribs are designed for conversion to day beds upon removal of the dropside. The ability to easily remove the dropside facilitates such conversion. As dropsides are frequently raised and lowered, the ability to do so smoothly is a desirable feature.

SUMMARY OF THE INVENTION

The invention relates to a crib dropside assembly and certain unique components thereof.

In accordance with the invention, an assembly for a crib is provided which includes a crib endboard, a dropside and a dropside track including a generally J-shaped pin track and a pin access slot extending between the pin track and an exterior surface of the dropside track. The dropside track is preferably mounted to the dropside. Means are provided for opening and closing the pin access slot. A pin is preferably secured to the crib endboard, and is slidably positioned within the pin track. The dropside may be coupled to the crib endboard by causing the pin to move through the pin access slot and into the pin track when the pin access slot is opened. The pin access slot is thereafter closed to prevent the dropside from being unintentionally uncoupled from the crib endboard.

A crib dropside assembly is further provided by the invention which includes a top rail, a bottom rail, and a plurality of connecting members extending between the top and bottom rails. A pin track including a relatively long and generally vertical segment, a relatively short and generally vertical segment, a connecting segment connecting the relatively long and short segments, and a pin access slot extending into one of the segments of the pin track. A moveable gate is provided for blocking the pin access slot when in a first position and opening the pin access slot when in a second position.

A pin track assembly is further provided by the invention. The assembly includes an elongate member, a pin track defined by the elongate member and including relatively short and relatively long vertical segments, a connecting segment, a pin access slot extending into one of the segments, and a gate coupled to the elongate member, the gate being movable between a first position blocking the pin access slot and a second position opening the slot. The pin track assembly is mountable to one of the dropside and crib corner post, but preferably to the dropside.

DETAILED DESCRIPTION OF THE INVENTION

The present invention provides a crib dropside that can be installed or removed easily. In addition to facilitating crib assembly for the consumer, it also allows the easy conversion of the crib to a day bed when the dropside is removed. The ability to convert a crib to a day bed is not a requirement of the invention.

Figure 1B:
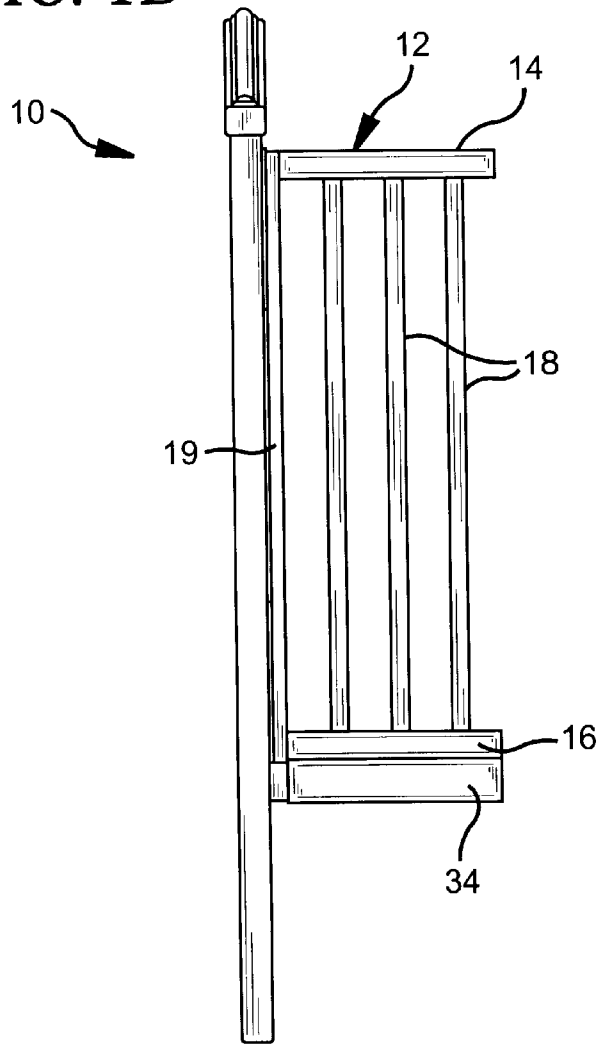
FIG. 1B is a side elevation view thereof.
Figure 1A:
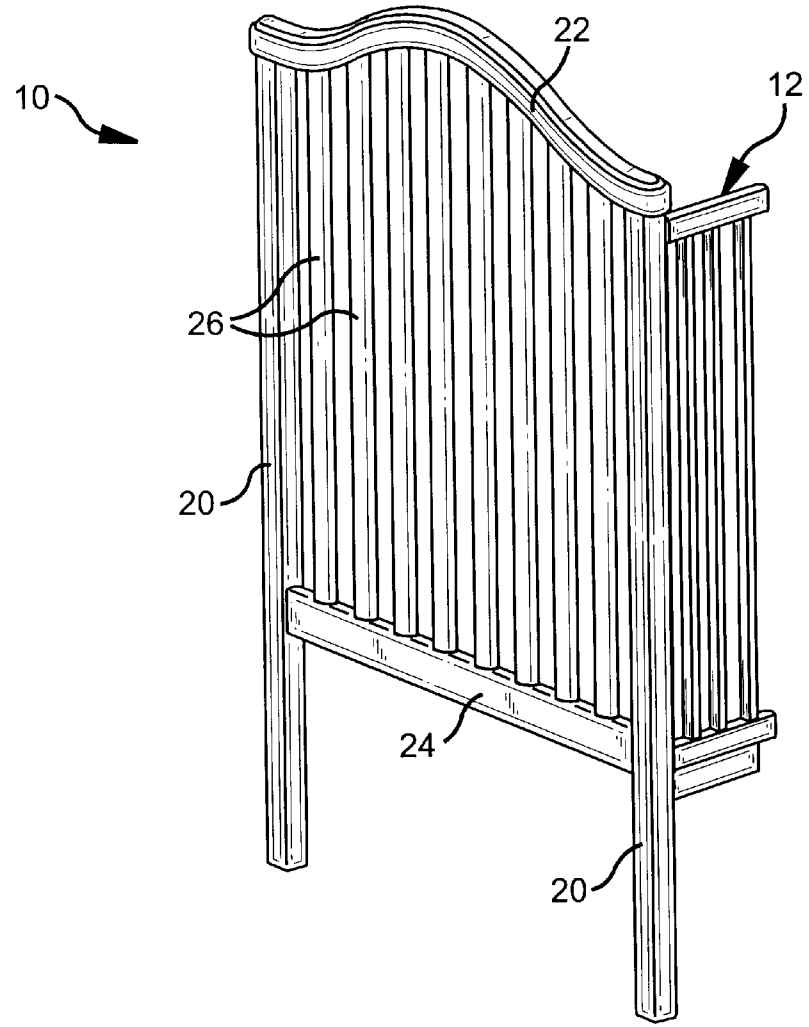
FIG. 1A is a perspective view showing one end of a crib having a dropside coupled thereto.

FIGS. 1A and 1B each show a crib endboard 10 having a dropside 12 mounted thereto. The dropside includes substantially parallel top and bottom rails 14, 16 connected by vertical slats 18 and end pieces 19. The crib endboard shown in the drawings includes a pair of corner posts 20 connected by top and bottom rails 22, 24. Vertical slats 26 or the like extend between the top and bottom rails.

Figure 2A:
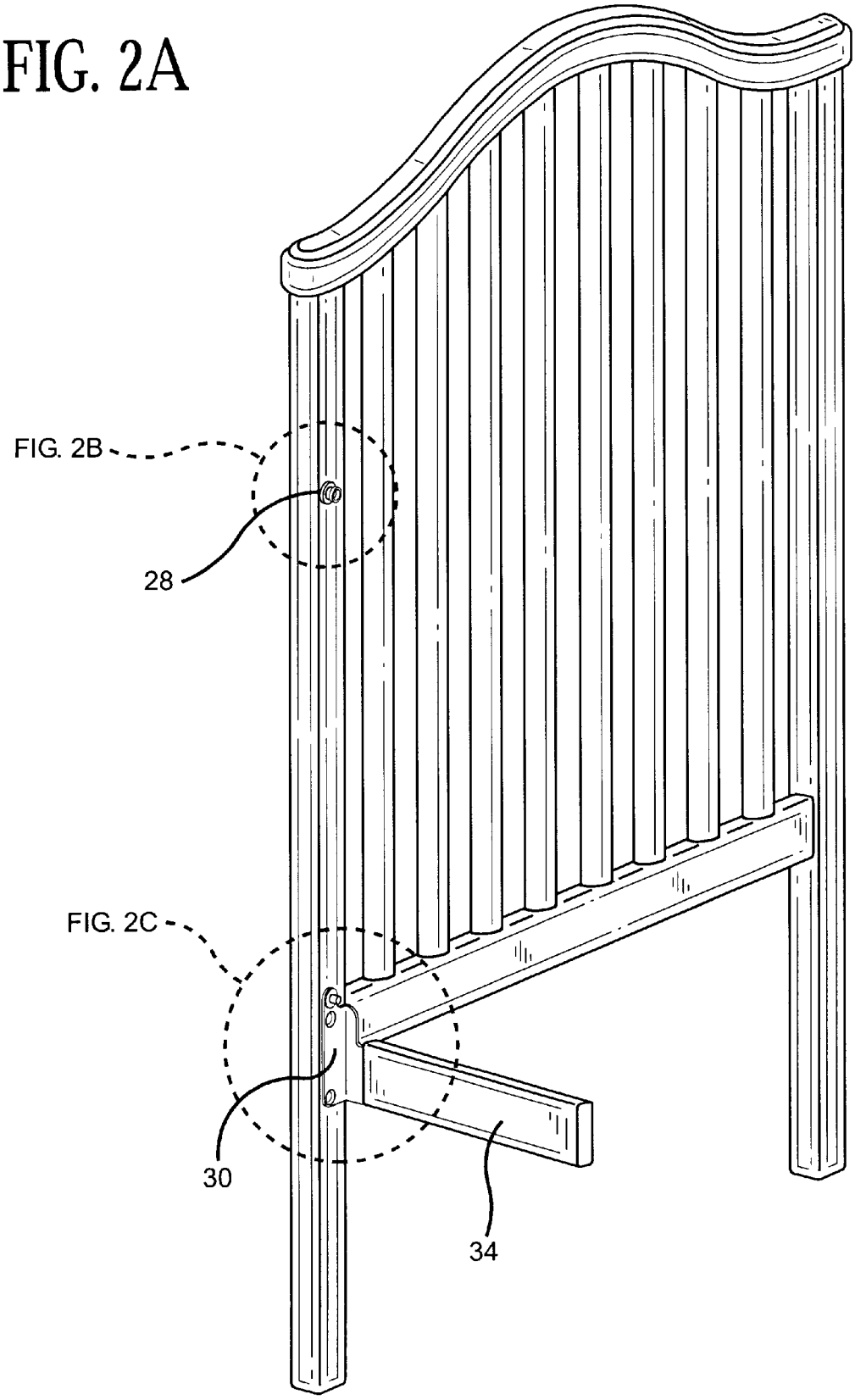
FIG. 2A is a rear perspective view of a crib endboard in accordance with the invention.
Figure 2B:
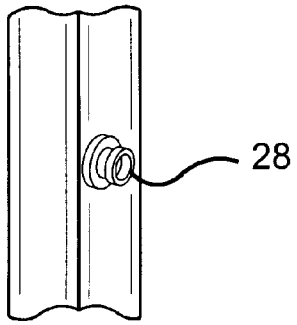
FIG. 2B is a perspective view showing an upper guide secured to a corner post of the crib endboard.
Figure 2C:
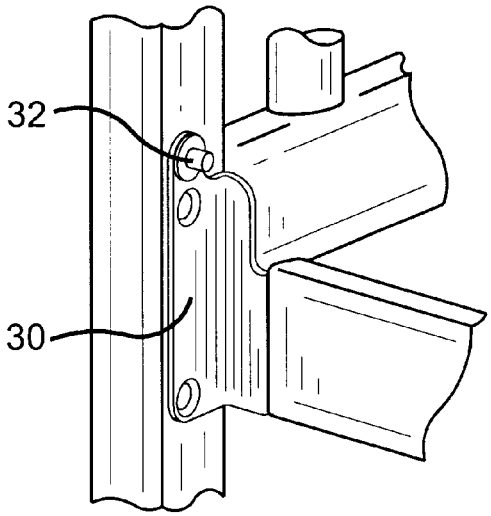
FIG. 2C is a top perspective view showing a stabilizing bar bracket coupled to the corner post of the crib endboard.

FIG. 2A shows the crib endboard having an upper guide 28 and a stabilizing bar bracket 30 secured to one of its corner posts. An enlarged view of the upper guide is shown in FIG. 2B. As shown in FIG. 2C, a track pin 32 is integral with the stabilizing bar bracket. Such positioning of the track pin is preferred, though not required. While not preferred, the positions of the track pin and pin track (discussed below) could be reversed. A stabilizing bar 34 is coupled to the bracket.

Figure 3A:
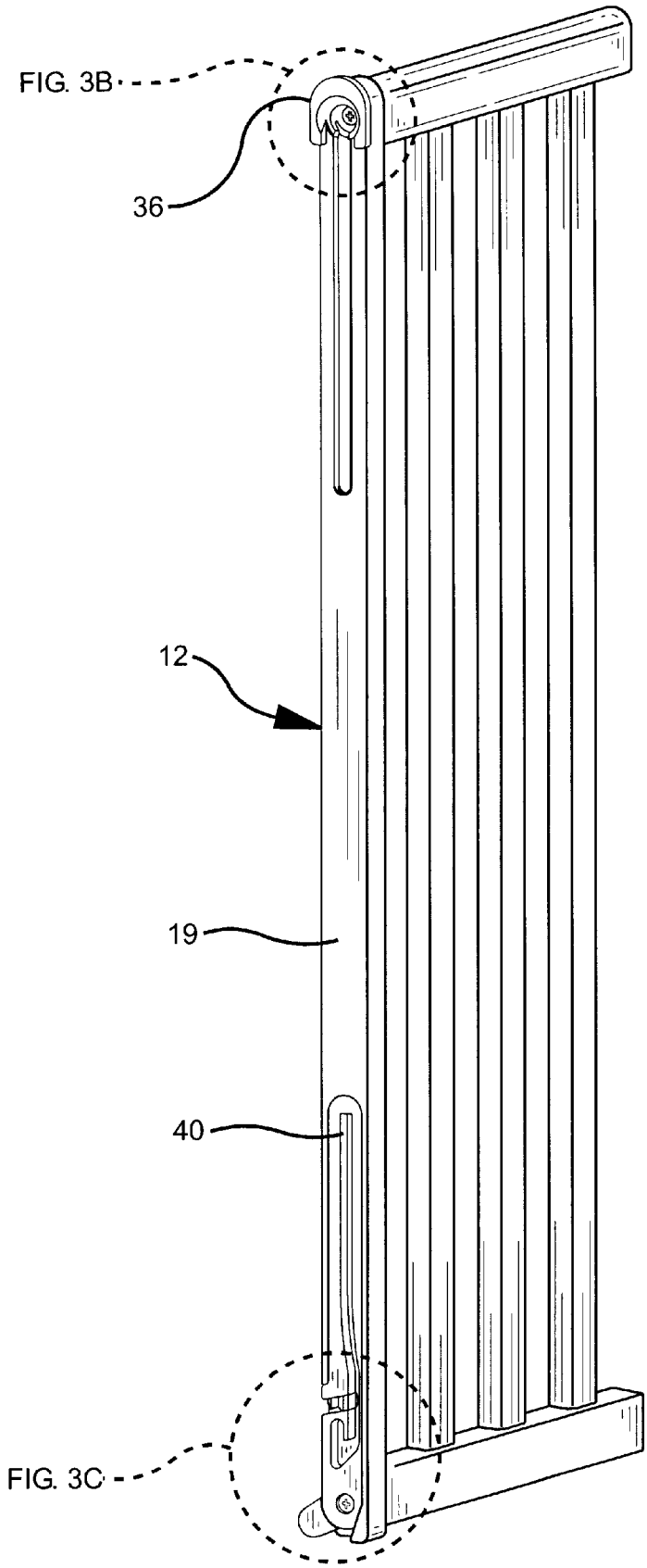
FIG. 3A is a perspective view showing an end portion of the dropside.
Figure 3B:
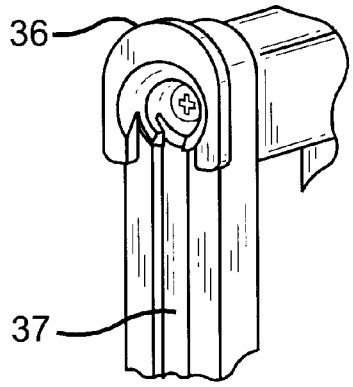
FIG. 3B is a top perspective view showing an end cap mounted to the dropside.
Figure 3C:
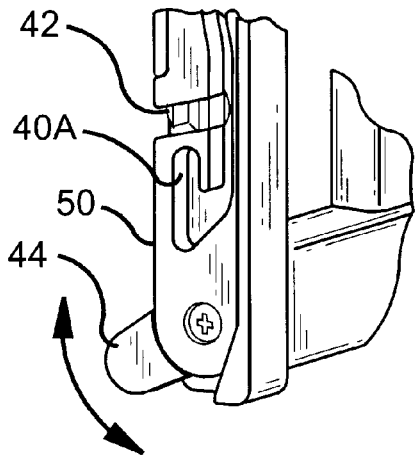
FIG. 3C is a top perspective view showing the pin track and pin gate provided on the crib dropside.

FIGS. 3A–3C show selected portions of the crib dropside. As best shown in FIG. 3B, the upper portion of the dropside includes an end cap 36 and a T-slot 37 for the upper guide 28. (The upper guide is shown in FIG. 2B.) The lower portion of the dropside includes an elongate member embedded therein which includes a pin track 40, a pin gate 42, and a pressure flipper 44. The track pin 32 shown in FIG. 2C is located within the pin track when the dropside is mounted to the crib endboard.

Figure 4A:
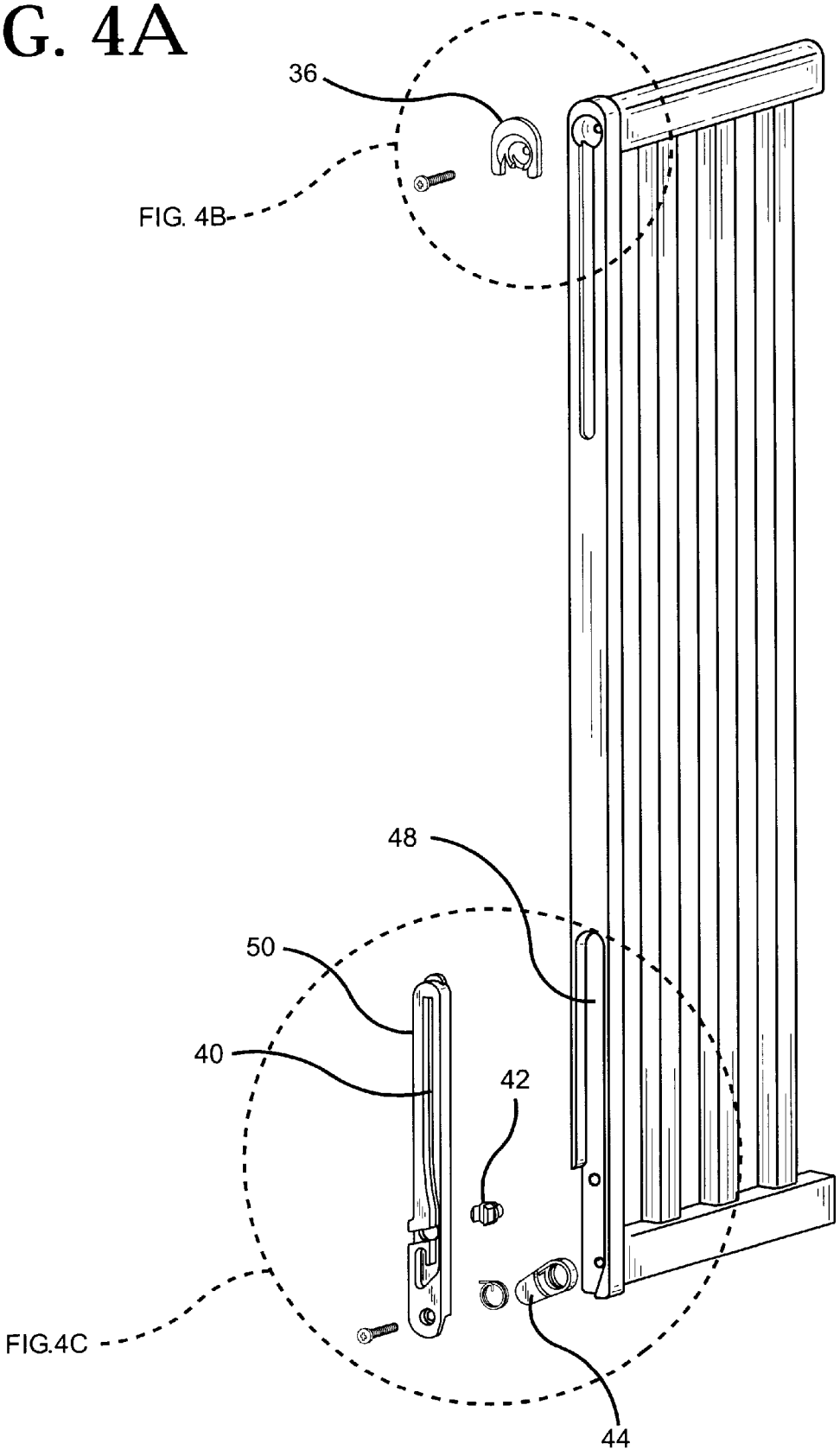
FIG. 4A is an exploded perspective view showing an end portion of the crib dropside.
Figure 4B:
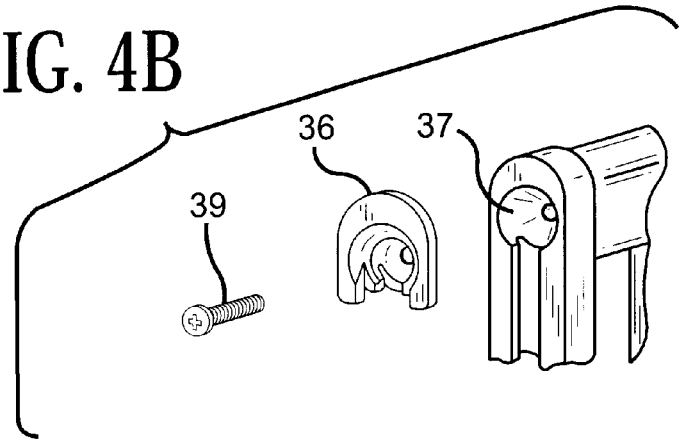
FIG. 4B is an exploded perspective view showing the top portion of the crib dropside.
Figure 4C:
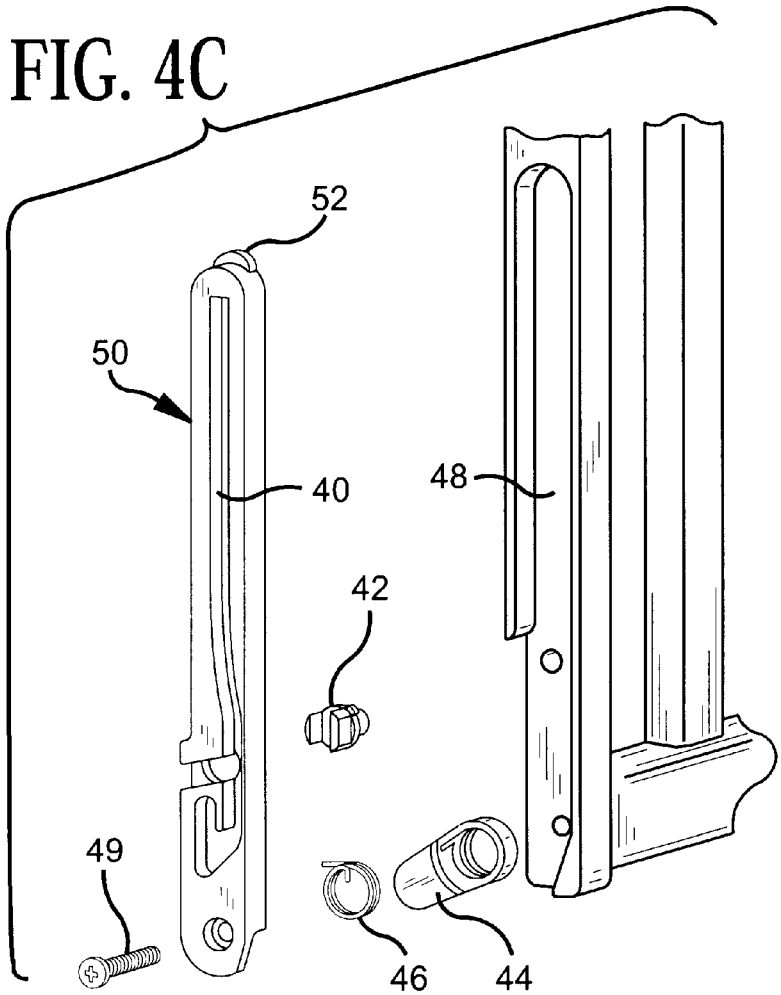
FIG. 4C is an exploded perspective view showing a bottom portion of the crib dropside.

FIGS. 4A–4C are exploded, perspective views of the dropside 12 and various elements coupled thereto. FIG. 4B shows the end cap 36, the recess 37 in the end piece for receiving the end cap, and the screw 39 for securing the end cap to the end piece 19. As shown in FIG. 4C, a spring 46 is coupled to the pressure flipper 44. The end rail of the dropside includes an elongate, substantially vertical groove 48 near its bottom end. A pair of openings extend within the groove, and are registrable with the openings near the bottom end of the elongate member. A screw 49 extends through lowermost openings when the elongate member is positioned within the groove 48.

FIGS. 5A–5G provide detailed views of the elongate member 50 which defines, inter alia, the pin track 40. The pin track is comprised of relatively short and long generally vertical segments 40A, 40B, and a connecting segment 40C. The upper end of the track 40 is enlarged for receiving a resilient bumper (not shown). The groove 48 in the dropside in which this elongate member is positioned is shown in FIGS. 4A and 4C. While the bottom of the elongate member is secured to the dropside by a screw, the upper end of the groove 48 includes an undercut which receives a lug 52 extending from the upper end of the elongate member. The track assembly for the dropside is shown in FIG. 4C, and includes the elongate member, the pin track, the track assembly screw, the pressure flipper spring, the track pin gate, and the pressure flipper.

Figure 6A:
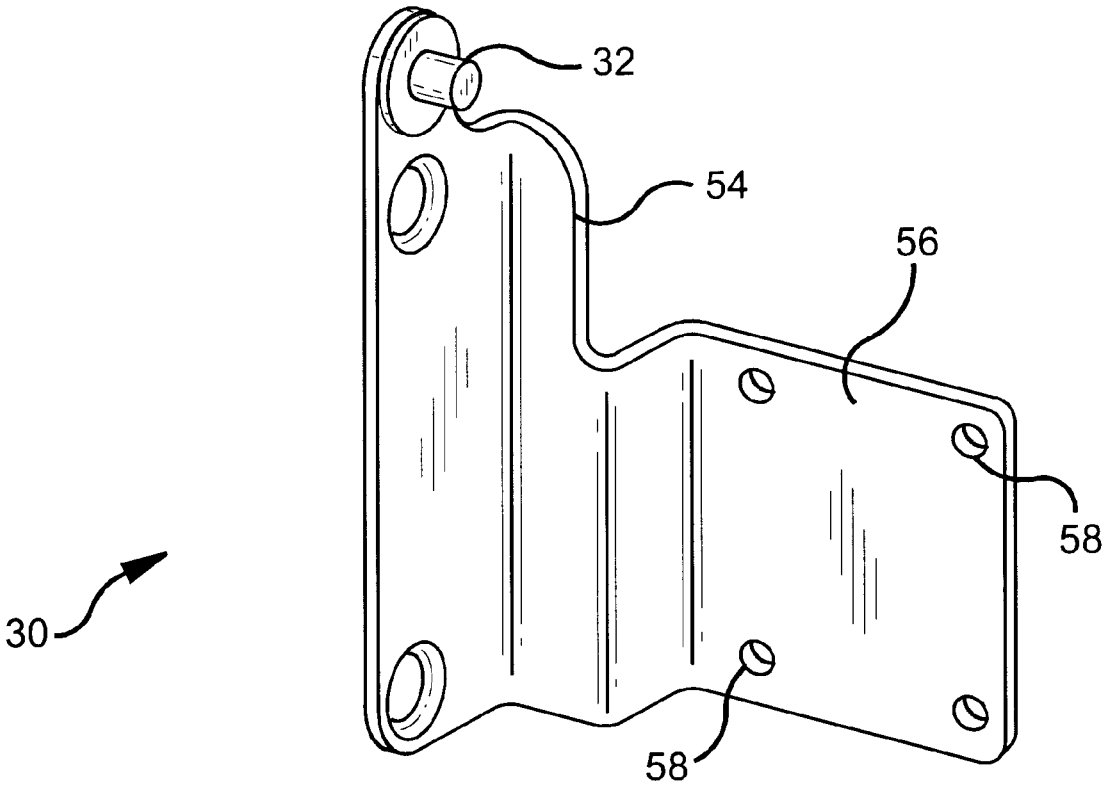
FIG. 6A is a top perspective view of a stabilizing bar bracket including a track pin.
Figure 6B:
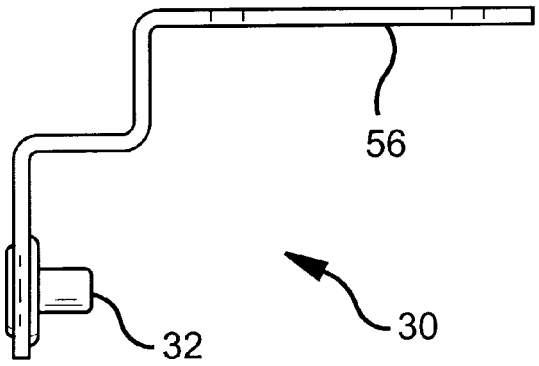
FIG. 6B is a top plan view thereof.
Figure 6C:
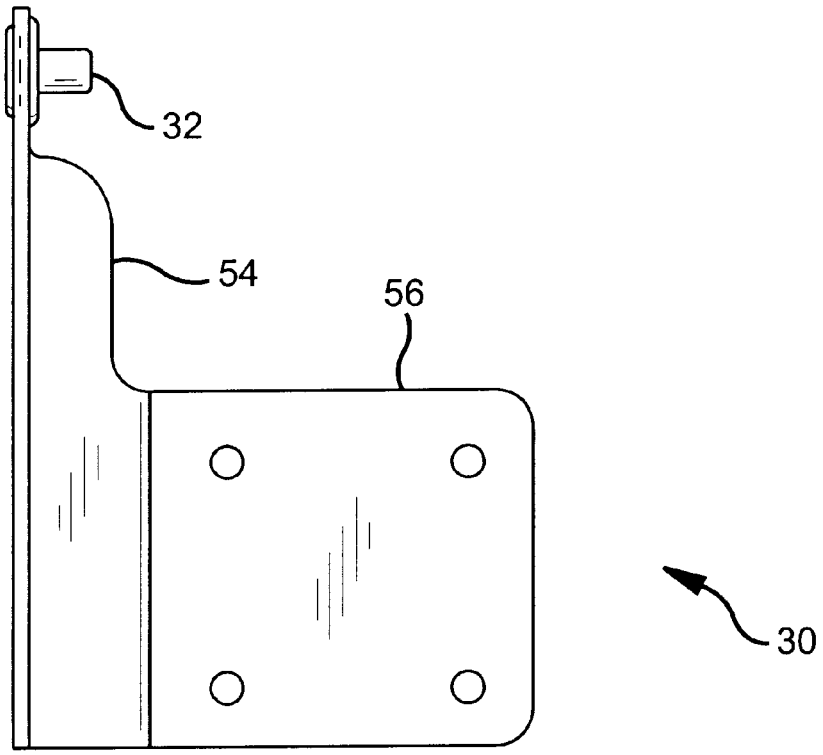
FIG. 6C is a side elevation view thereof.

FIGS. 6A–6C provide detailed views of the stabilizing bar bracket 30, which was discussed above in connection with FIG. 2C. It includes a surface 54 for activating the pressure flipper. This particular bracket includes a plate 56 having mounting holes 58 for a wood stabilizing bar 34. In the event a metal stabilizing bar is to be employed, different coupling means would be utilized.

Figure 5A:
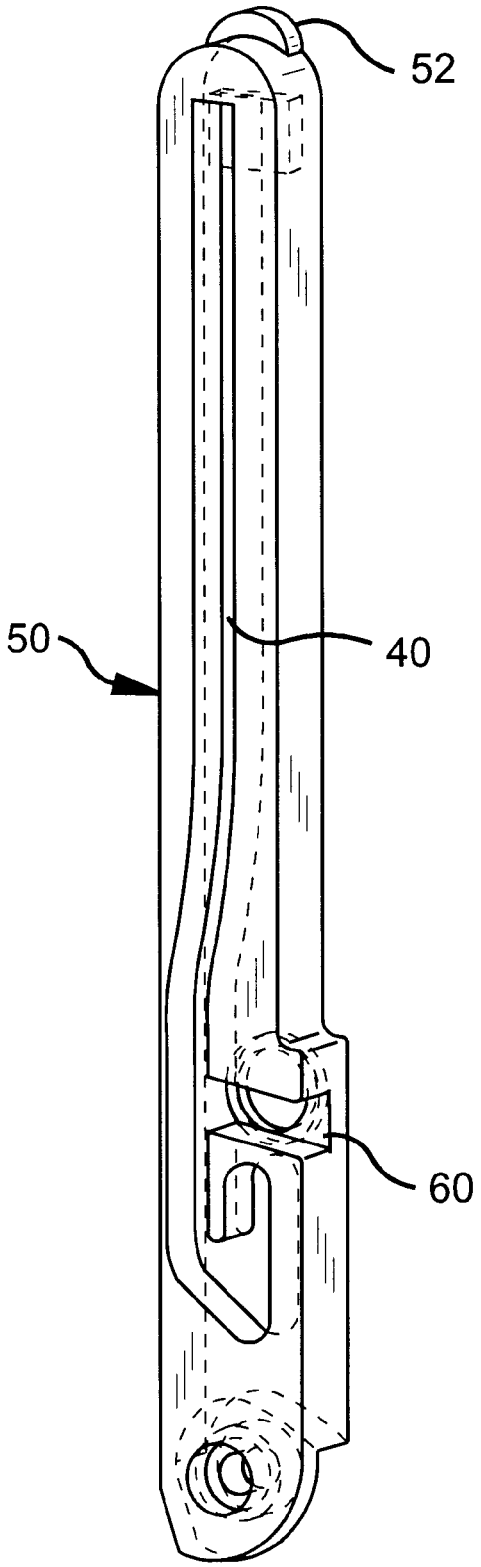
FIG. 5A is a top perspective view showing an elongate member which forms the pin track.
Figure 5B:
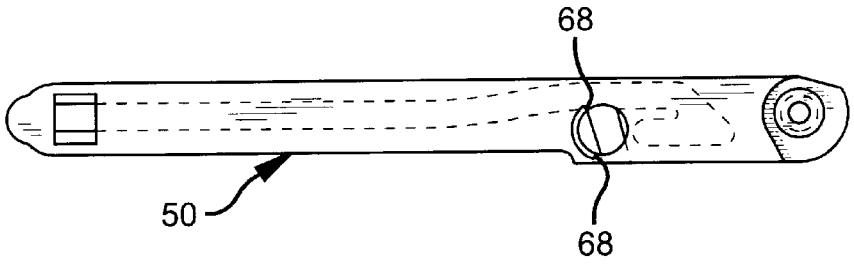
FIG. 5B is a bottom plan view thereof.
Figure 5C:
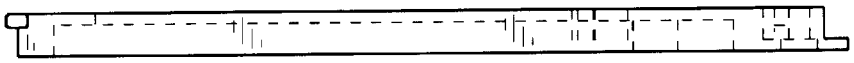
FIG. 5C is a side elevation view thereof.
Figure 5D:
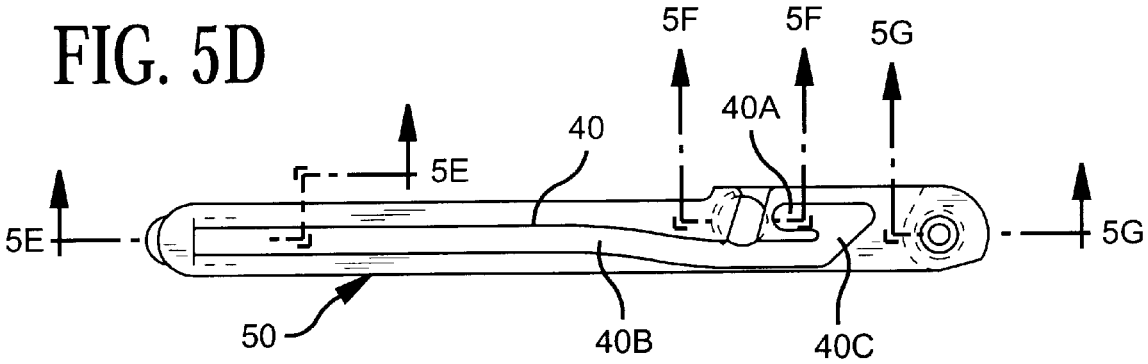
FIG. 5D is a top plan view thereof.
Figure 5E:
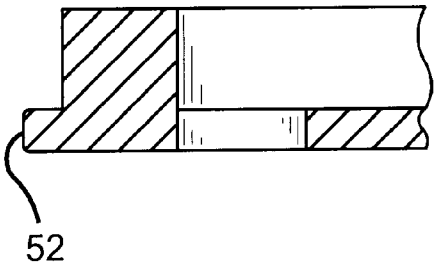
FIG. 5E is a sectional view taken along line 5E—5E of FIG. 5D.
Figure 5F:
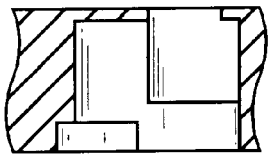
FIG. 5F is a sectional view taken along line 5F—5F of FIG. 5D.
Figure 5G:
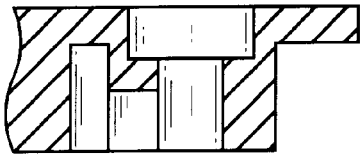
FIG. 5G is a sectional view taken along line 5G—5G of FIG. 5D.
Figure 7A:
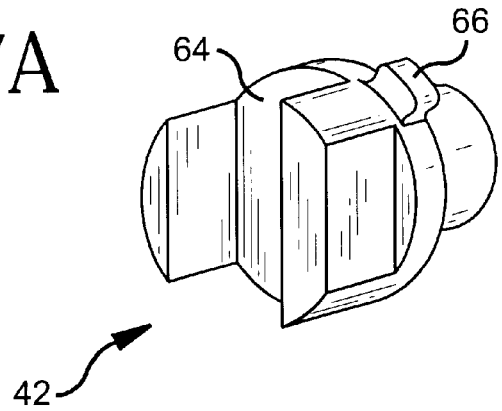
FIG. 7A is a top perspective view of a pin gate according to the invention.
Figure 7B:
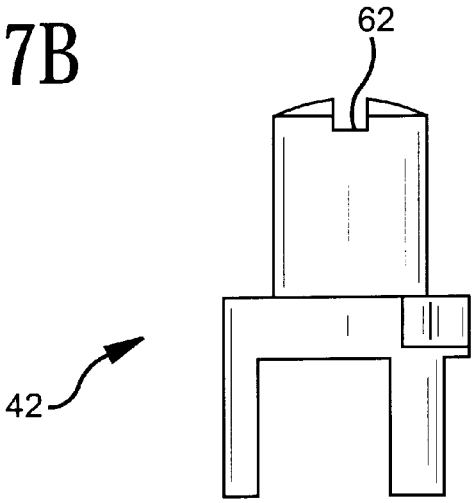
FIG. 7B is a side elevation view thereof.
Figure 7C:
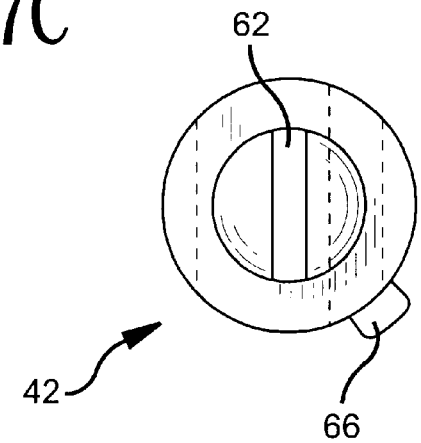
FIG. 7C is a bottom plan view thereof.

FIGS. 7A–7C provide detailed views of the preferred pin gate 42, which is also shown in FIGS. 3C and 4C. The pin gate is rotatably mounted to the elongate member 50, as shown in FIG. 3C, to control access to and from the pin track 40. As shown in FIG. 5A, the track includes a pin access slot 60. The pin gate can be rotated to block the pin access slot once the track pin is positioned in the pin track. Using the driver slot 62 shown in FIG. 7B, the pin gate can be rotated to align a pin passageway 64 in the pin gate with the pin access slot 60, thereby permitting the track pin 32 to move in either direction through the pin access slot and into the pin track 40. As seen in the figures, for example FIG. 4C, the pin can move in the pin track along a generally elongated axis, and the pin can move in the access slot, through the passageway of the pin gate, along a generally elongated axis, the axis of the pin track and the axis of the access slot being generally coplanar. A stop lug 66 is provided to prevent over-rotation of the pin gate and to perform an indexing function. It is engageable with opposing stops 68 formed in the elongate member 50, which are shown in FIG. 5B. The lug and stops ensure that the pin passageway is properly aligned to open or close the pin access slot when the pin gate is rotated by the user between selected positions. While the pin gate 42 described herein is adapted to be rotated with the use of a screwdriver, it will be appreciated that other means to provide rotation with or without the use of a separate tool may be employed.

Figure 8A:
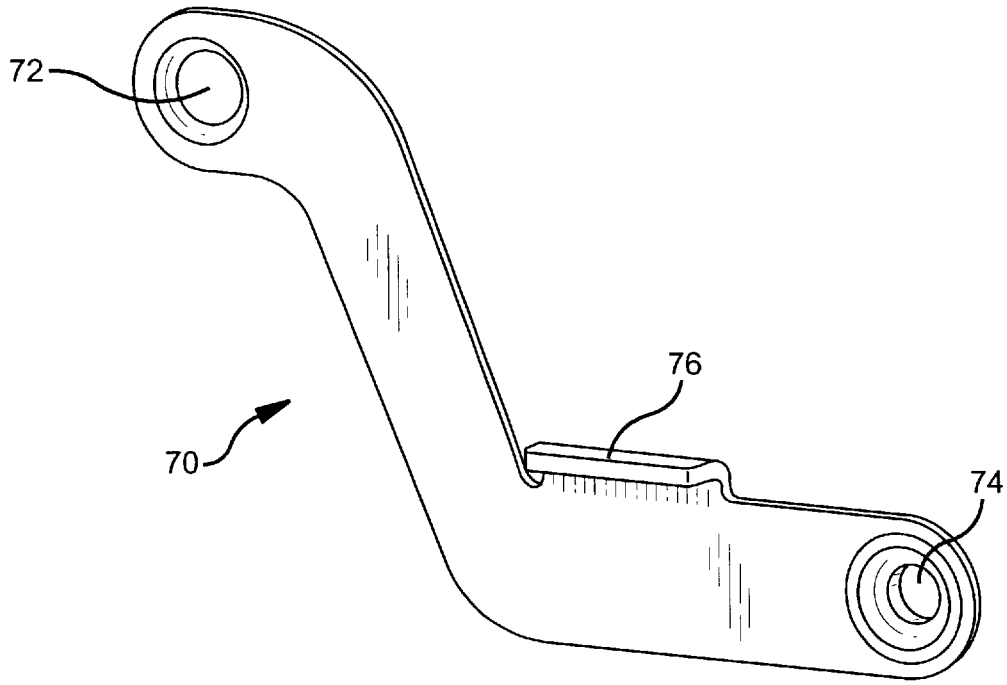
FIG. 8A is a perspective view showing a spring hanger.
Figure 8B:
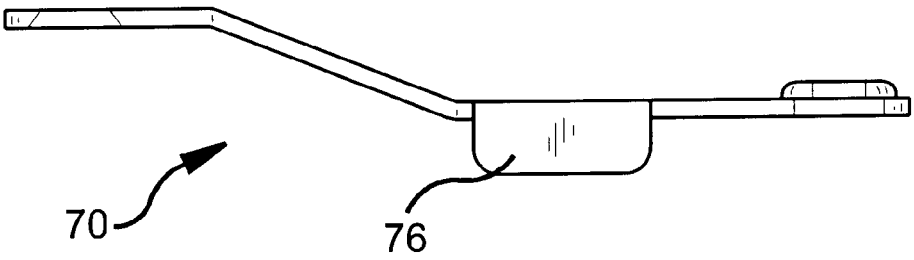
FIG. 8B is a top plan view thereof.
Figure 8C:
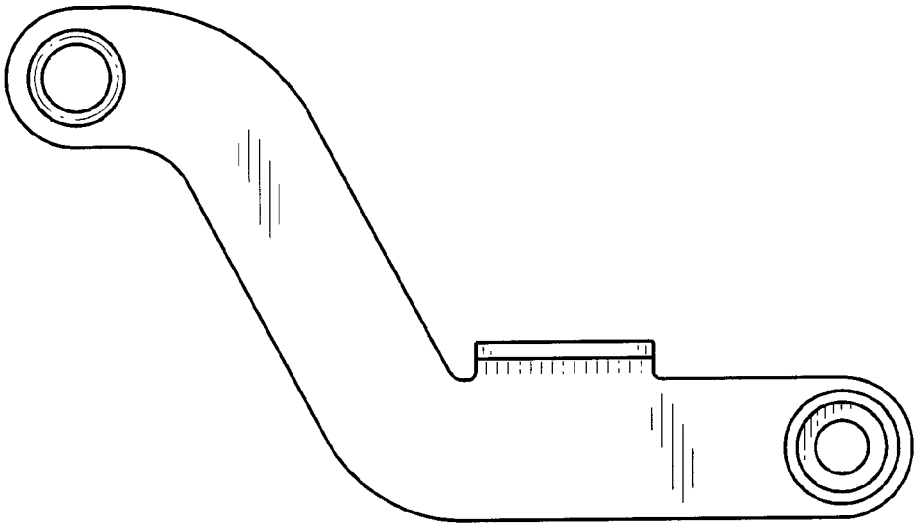
FIG. 8C is a side elevation view thereof.

FIGS. 8A–8C include detailed views of a spring hanger 70, one of which is mounted to each corner post. A first hole 72 is provided near one end for securing the hanger to a corner post. A second hole 74 near the other end is used to couple it to a spring deck (not shown). A laterally extending tab 76 is engageable with the spring deck frame, which limits its rotation.

Figure 9A:
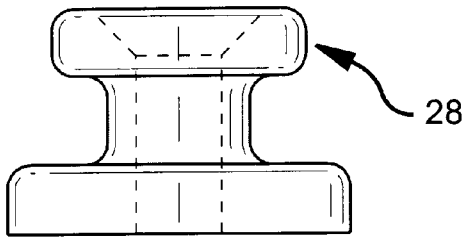
FIG. 9A is a side elevation view of the upper guide.
Figure 9B:
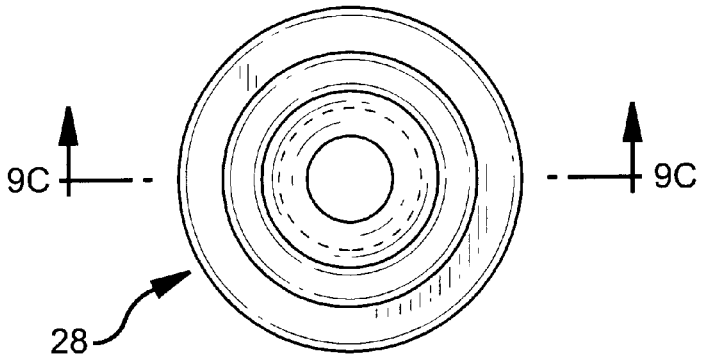
FIG. 9B is a top plan view thereof.
Figure 9C:
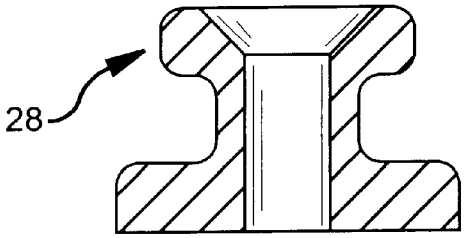
FIG. 9C is a sectional view taken along line 9C—9C of FIG. 9B.

FIGS. 9A–9C provide detailed views of the upper guide 28, which is also shown in FIGS. 2A and 2B. The guide includes round corners to minimize friction as it travels in the T-slot 37 shown in FIG. 3B. It further includes a counterbored passage so that it may be coupled to a corner post 20 with a screw.

Figure 10A:
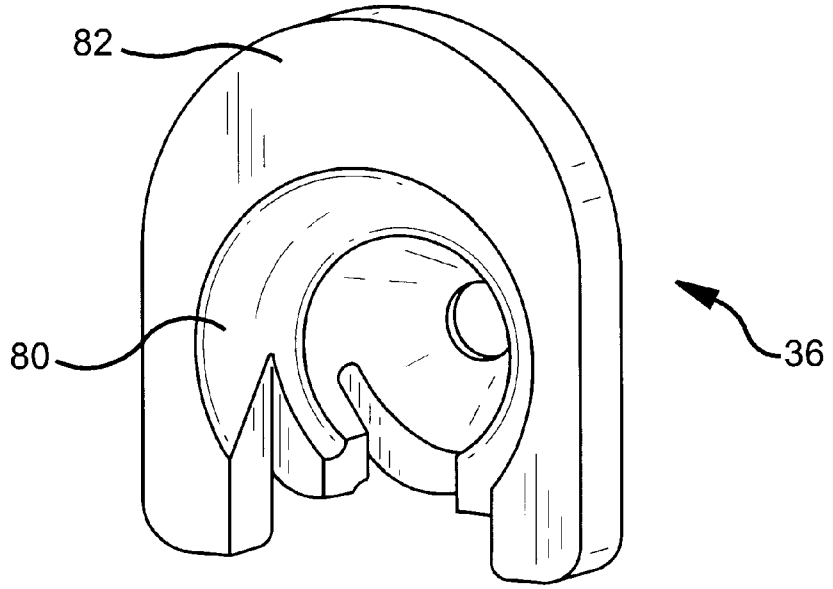
FIG. 10A is a top perspective view of the end cap.
Figure 10B:
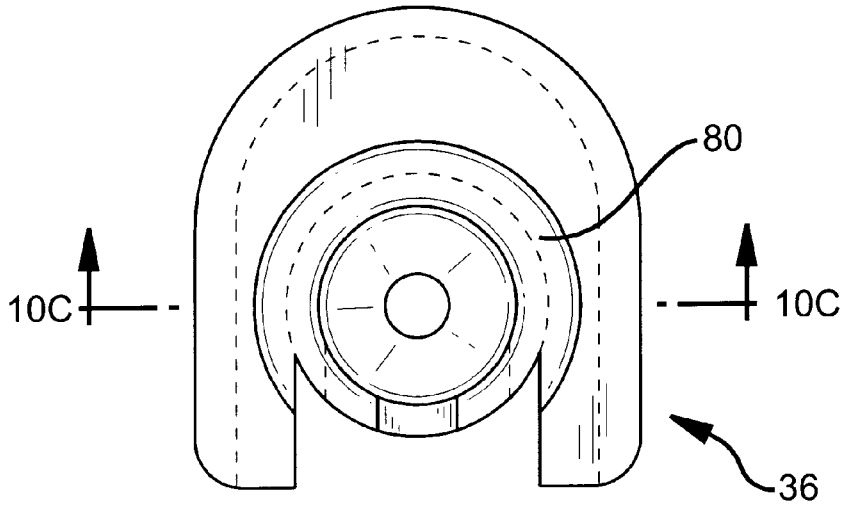
FIG. 10B is a front elevation view thereof.
Figure 10C:
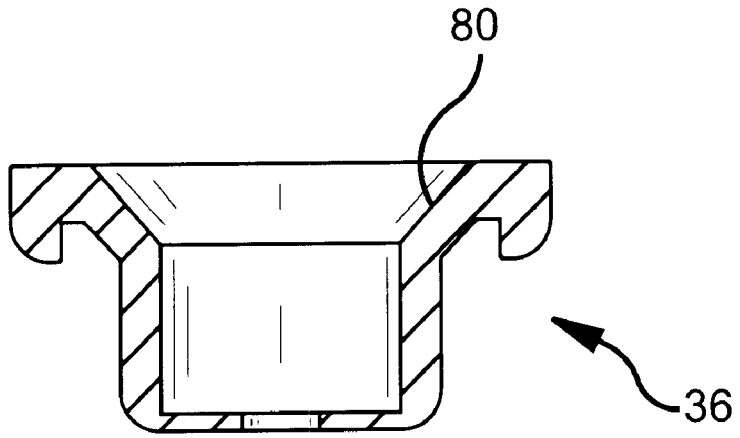
FIG. 10C is a sectional view taken along line 10C—10C of FIG. 10.
Figure 10D:
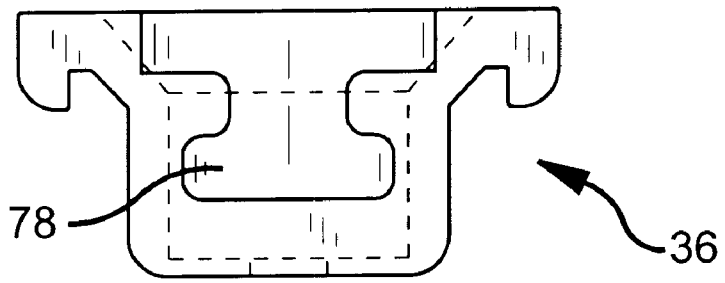
FIG. 10D is a front elevation view thereof.

The dropside top end cap 36 is shown in detail in FIGS. 10A–10D. As shown in FIG. 10D, it includes a T-slot 78. This slot is aligned with the T-shaped slot 37 in the dropside, as shown in FIG. 3B. The end cap includes a guide funnel 80 which allows the user to locate the end cap 36 over the upper guide 28 very easily. This greatly facilitates assembly of the dropside to the crib ends. The cap also fills the gap between the dropside and the crib endboard. The cap surface 82 also functions as a glide that runs up and down on the crib corner post 12 to help eliminate scratching and make it easier to operate.

Figure 11A:
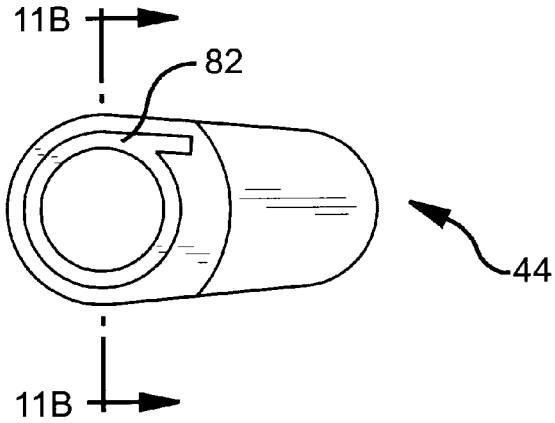
FIG. 11A is a top plan view of a pressure flipper.
Figure 11B:
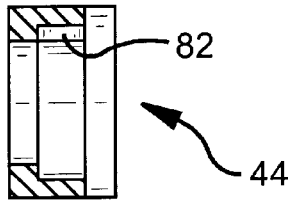
FIG. 11B is a sectional view thereof taken along line 11B—11B of FIG. 11 A.
Figure 11C:
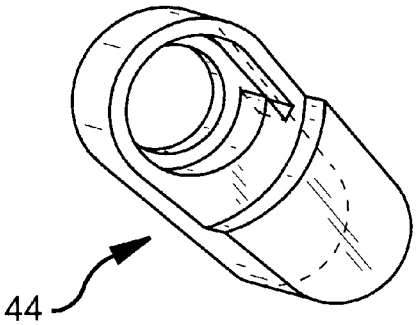
FIG. 11C is a perspective view thereof.
Figure 12A:
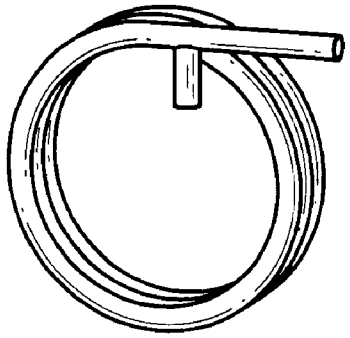
FIG. 12A is a perspective view of a pressure flipper spring.
Figure 12B:
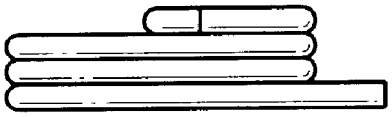
FIG. 12B is a top plan view thereof.

FIGS. 11A–11C provide detailed views of the pressure flipper 44. This member is shown as assembled to the dropside in FIGS. 3C and 4C. FIGS. 12A–12B provide detailed views of the pressure flipper spring 46 which is positioned within the spring pocket 82 as labeled in FIG. 11A. The pressure flipper, under the force of the associated spring, apply pressure to the dropside when it is raised and comes in contact with the stabilizing bar bracket 30, pushing the dropside out and allowing the pin 32 extending from the stabilizing bar bracket to fall into the locked position of the track. As discussed above, the stabilizing bar bracket has a surface 54 for causing the pressure flipper to become activated when the dropside is raised into the locked position. (The track pin 32 is positioned against the upper wall of the shorter vertical segment 40A of the pin track 40 when the dropside is in the raised, locked position.)

The embodiment of FIGS. 1–12 is assembled in the following manner. The upper guide 28, stabilizing bar 34 and bracket 30 are assembled to the crib endboard 10 as shown in FIG. 2A. The dropside 12 is mounted to the crib endboard by placing the dropside end caps 36 over the upper guides 28 on the crib endboards, then swinging the lower dropside over the pins 32 on the stabilizing bar brackets. The track pin gates may be rotated to accommodate the pins, if necessary. As discussed above, the stop lugs 66 ensure that the pin access slots are either fully open or fully closed, thereby providing an indexing function to assist the user. The dropside is raised into the upper position, and the track pin gate is then rotated until the stop lug is again engaged, thereby indicating closure of the pin access slot 60. When the dropside is raised into the locked position, the pressure flipper rides 44 on the surface of the stabilizing bar bracket, applying pressure to the dropside and forcing it into the locked position. The dropside is easily removed by reversing the above described process.

Figure 13A:
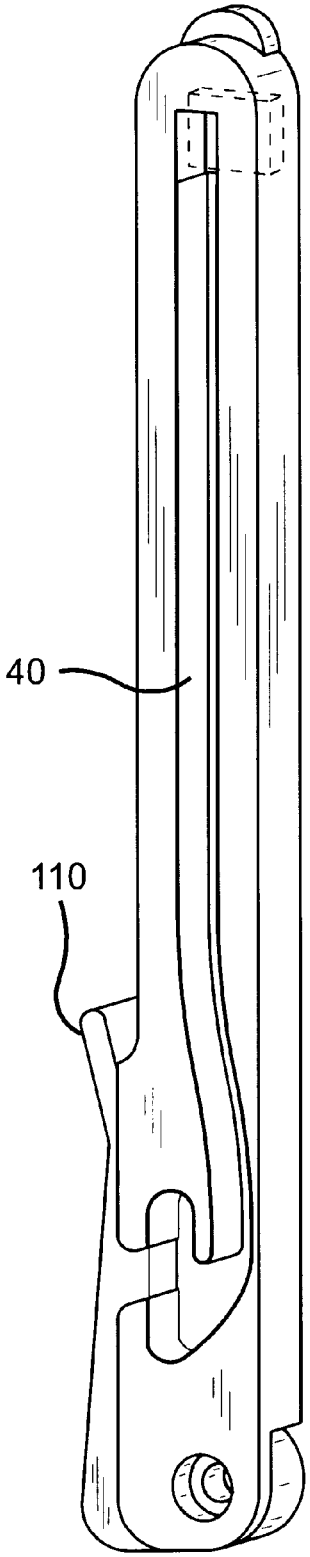
FIG. 13A is a top perspective view of an alternative embodiment of the dropside track according to the invention.
Figure 13B:
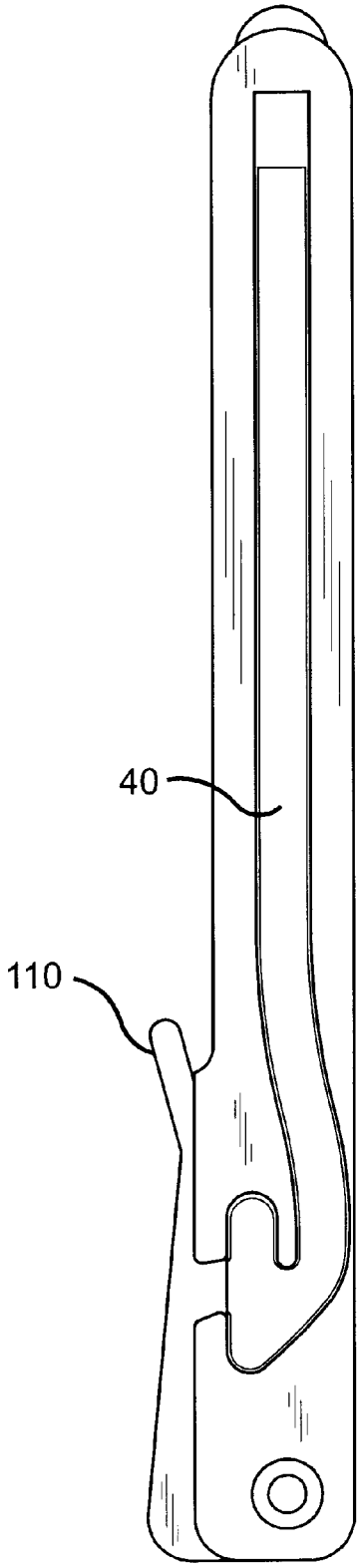
FIG. 13B is a top plan view thereof.
Figure 14:
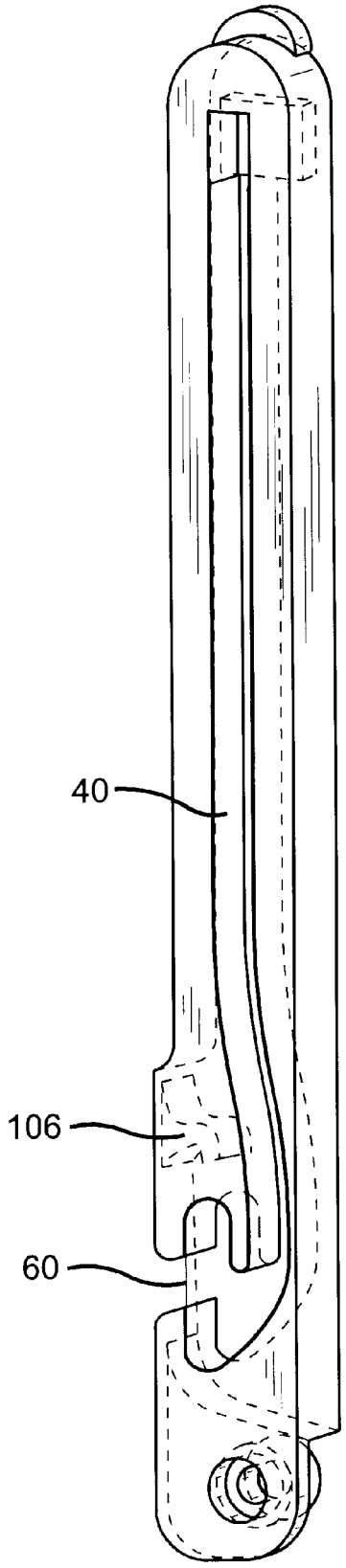
FIG. 14 is a top perspective view thereof without a pin gate.
Figure 15:
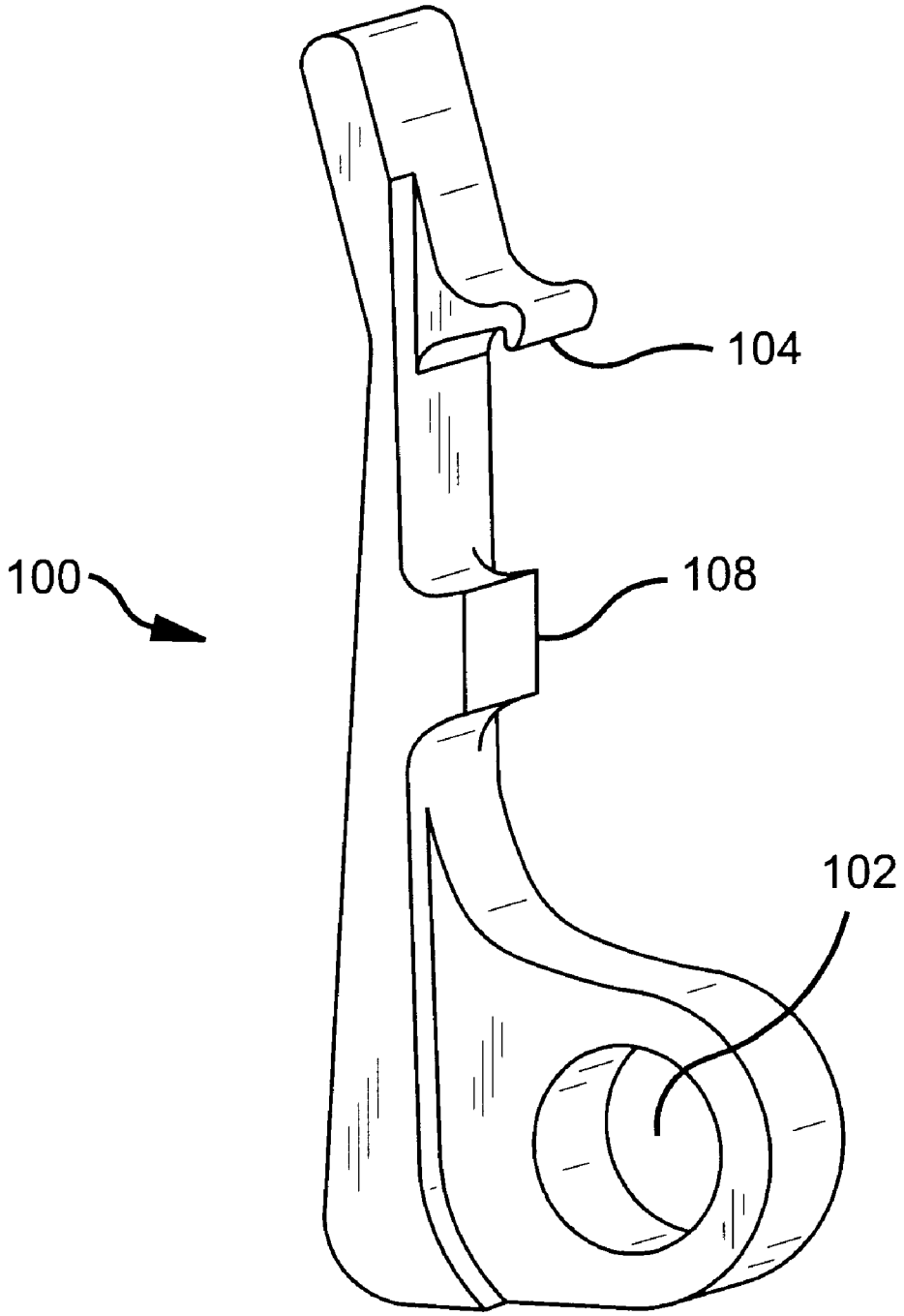
FIG. 15 is a top perspective view of the pin gate.

FIGS. 13A, 13B and 14 show an alternative embodiment of the dropside track. In this embodiment, the rotatable track pin gate of the first embodiment is replaced by a pivotable gate 100, as best shown in FIG. 15. The gate includes an opening 102 at one end which allows it to be pivotably secured to the track, and a hook 104 near the other end for engaging an undercut portion 106 of the track to maintain it in a closed position. The central portion 108 of the gate closes off the pin access slot, as shown in FIG. 13B. A tab 110 allows the gate to be easily maneuvered by user. Other forms of gates could also successfully be employed, such as a slidable member mounted to the elongate member. While some form of attachment of the gate to the elongate member is highly preferred, the use of a separable stop is also a possibility. The stop may be connected to the elongate member by a tether or the like, or not connected at all. Such a stop would be removably insertable in the pin access slot and maintained therein by a suitable detent mechanism.

While the drawings provided herein show only one side of a crib end or dropside, it will be appreciated that the hardware disclosed herein is preferably provided at both sides thereof It will also be appreciated that while preferred embodiments of the invention have been described herein, the scope of the invention is not limited to these particular embodiments.

What is claimed is:

1. An assembly for a crib comprising:

a crib endboard;

a dropside;

a dropside track mounted to said dropside including a generally J-shaped pin track, and a pin access slot extending between said pin track and an exterior surface of said dropside track, the pin access slot and the pin track being generally coplanar;

means for opening and closing said pin access slot; and a pin secured to said crib endboard and slidably positioned within said pin track.

2. An assembly as described in claim 1, wherein said means for opening and closing said pin access slot is a rotatable gate positioned at least partially within said pin access slot.

3. An assembly as described in claim 2 including means for limiting the rotatability of said gate between a first position wherein said gate is open such that said pin can pass through said pin access slot and a second position wherein said gate blocks said pin access slot.

4. An assembly as described in claim 3, wherein said pin track includes a relatively long vertical segment and a relatively short vertical segment, said pin access slot intersecting said relatively long vertical segment.

5. An assembly as described in claim 3, wherein said gate includes a pin passage way alignable with said pin access slot and a barrier adjoining said pin passage way.

6. An assembly as described in claim 1 including an upper guide mounted to said crib endboard, a vertical slot in said dropside for slidably retaining said upper guide, and an end cap adjoining said vertical slot, said end cap including a generally conical opening adjoining an upper end of said vertical slot.

7. An assembly as described in claim 6, wherein said end cap includes a glide surface closely adjoining said crib endboard.

8. An assembly as described in claim 1 including a pressure flipper pivotably mounted to said dropside track and a spring biasing said pressure flipper.

9. An assembly as described in claim 8, wherein said pressure flipper includes a spring pocket, said spring being positioned within said spring pocket.

10. An assembly as described in claim 1, wherein said means for opening and closing said pin access slot is a gate pivotably mounted to said dropside track, said gate being pivotable between a first position blocking entry to said pin access slot and a second position allowing entry by said pin into said pin access slot.

11. An assembly as described in claim 10 including a detent mechanism for releasably engaging said dropside track and said gate when said gate is in said first position.

12. A crib dropside assembly comprising:

a top rail;

a bottom rail;

a plurality of connecting members extending between said top and bottom rails;

a pin track including a relatively long and generally vertical segment, a relatively short and generally vertical segment, a connecting segment connecting said relatively long and short segments, and a pin access slot extending into one of said segments of said pin track, the pin access slot and the pin track being generally coplanar, said pin track being coupled to one of said connecting members, and a movable gate for blocking said pin access slot when in a first position and opening said pin access slot when in the second position.

13. An assembly as described in claim 12, wherein said gate is rotatably mounted within said pin access slot.

14. An assembly as described in claim 13, wherein said gate includes a passage alignable with said pin access slot.

15. An assembly as described in claim 14, wherein said gate includes a stop lug, said pin track is defined by an elongate member coupled to one of said connecting members, said elongate member including a pair of stops which are engageable with said stop lug.

16. An assembly as described in claim 15 including a spring-loaded pressure flipper pivotably mounted to one of said connecting members.

17. An assembly as described in claim 12, wherein said pin track is defined by an elongate member and said gate is pivotably coupled to said elongate member.

18. An assembly as described in claim 12 including a second, generally vertical slot defined in said one of said connecting members, an end cap mounted to said one of said connecting members and having an opening communicating with said second, generally vertical slot, said end cap further defining a glide surface extending from said one of said connecting members.

19. A pin track assembly for a crib dropside, comprising:

an elongate member;

a pin track defined by said elongate member and including relatively short and relative long, generally vertical segments, a connecting segment connecting said relatively short and relatively long segments, and a pin access slot extending into one of said segments and having an open end for admitting a pin, the pin access slot and the pin track being generally coplanar, and a gate movably coupled to said elongate member and movable between a first position blocking said pin access slot and a second position opening said pin access slot.

20. A pin track assembly as described in claim 19, wherein said gate is rotatably positioned within said pin access slot and includes a pin passageway aligned with said pin access slot when said gate is in said second position.

21. A pin track assembly as described in claim 19, wherein said gate is pivotably secured to said elongate member, said gate including a first portion for blocking said open end of said pin access slot when said gate is in said second position.

* * * * *